US008593078B1

(12) United States Patent
Xiong

(10) Patent No.: US 8,593,078 B1
(45) Date of Patent: Nov. 26, 2013

(54) UNIVERSAL DIMMING BALLAST PLATFORM

(75) Inventor: Wei Xiong, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 293 days.

(21) Appl. No.: 13/039,909

(22) Filed: Mar. 3, 2011

Related U.S. Application Data

(60) Provisional application No. 61/431,681, filed on Jan. 11, 2011.

(51) Int. Cl.
*H05B 37/02* (2006.01)

(52) U.S. Cl.
USPC ..... 315/307; 315/94; 315/224

(58) Field of Classification Search
USPC ..... 315/94, 106, 209 R, 224, 244, 291, 294, 315/307–309, DIG. 5, DIG. 7
See application file for complete search history.

(56) References Cited

U.S. PATENT DOCUMENTS 5,994,848 A * 11/1999 Janczak ..... 315/224
6,348,769 B1 * 2/2002 Pinchuk et al. ..... 315/307
6,657,401 B2 * 12/2003 Kominami et al. ..... 315/291
7,187,132 B2 3/2007 Bakre
7,247,991 B2 7/2007 Chen et al.
8,294,384 B2 * 10/2012 Matsuda ..... 315/279
2006/0103317 A1 5/2006 Chen et al.
2006/0138968 A1 * 6/2006 Bakre ..... 315/209 R
2007/0296355 A1 * 12/2007 Hamamoto et al. ..... 315/309
2011/0095698 A1 * 4/2011 Sasakawa et al. ..... 315/287

* cited by examiner

*Primary Examiner* — Tung X Le
(74) *Attorney, Agent, or Firm* — Waddey Patterson; Mark J. Patterson; Gary L. Montle

(57) ABSTRACT

A universal dimming topology is provided for an electronic ballast having an inverter providing an output current across first and second output branches for driving a light source in accordance with a dimming control input signal. A filament voltage control block modulates first and second filament heating switches to provide filament heating voltage across first and second connection terminals associated with the output branches. During a preheat operating mode a control block disables the inverter and provides pulse width modulated control signals to the filament voltage control block to modulate the filament heating switches at a predetermined frequency. During a normal operating mode the control block enables the inverter and provides pulse width modulated control signals to the filament voltage control block to modulate the filament heating switches in accordance with a duty ratio based on a detected output current.

19 Claims, 10 Drawing Sheets

UNIVERSAL DIMMING BALLAST PLATFORM

CROSS-REFERENCES TO RELATED APPLICATIONS

This application claims benefit of the following patent application(s) which is/are hereby incorporated by reference: U.S. Provisional Patent Application No. 61/431,681, filed on Jan. 11, 2011.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND OF THE INVENTION

The present invention relates generally to electronic ballasts for powering one or more light sources. More particularly, this invention pertains to a universal dimming ballast platform for powering light sources in accordance with a plurality of lighting applications.

Program start dimming ballasts as are known in the art are useful in environments where light sources (e.g., lamps) are frequently turned on and off, and light levels need to be adjusted to save energy. Typically, a dimming ballast can only drive one type of lamp because the filament voltage is specially designed for this type of lamp.

Certain dimming methods as known in the art wherein the filament heating voltage and lamp current are inversely controlled in a directly proportional manner. These conventional methods are less than optimal, in that the heating voltage and lamp current cannot be adjusted independently. The filament heating is set in such a way that when the lamp is at a minimum holding current the filament heating is set at a maximum level, and when the lamp current is modulated to one hundred percent, the filament heating is at a minimum level. Further, where the lamp current is a PWM current controlled between a maximum and a minimum setting the lamp current crest factor will be much greater than 1.7. Lamp life is generally reduced in accordance with high lamp current crest factors greater than 1.7 and therefore this rating is strongly recommended by lamp manufacturers and the industry in general.

It would be desirable to provide, then, an electronic ballast that can drive multiple types of lamps and independently adjust filament heating voltage according to requirements of a particular lamp current.

It would be further desirable for the electronic ballast to provide continuous dimming, and PWM filament heating rather than PWM lamp current control, such that the lamp current envelope is flat and the lamp current crest factor is appropriate.

BRIEF SUMMARY OF THE INVENTION

In accordance with various embodiments of the present invention, an electronic ballast is provided as part of a universal dimming platform with preheating capacity, and is effective to independently and flexibly adjust filament voltage during a dimming mode.

In an aspect of the present invention, the universal dimming ballast platform is effective to drive a series of lamps that have the same lamp current and same lamp filament, including for example T5 35 W, 28 W, 21 W, and 14 W lamps, etc.

In another aspect of the present invention, the universal dimming ballast platform can generate zero glow current during the lamp startup process, thereby extending lamp life.

In another aspect of the present invention, the universal dimming ballast platform addresses a low frequency (steady state) pin leakage current problem associated with, for example, the T5 lamp as known to those of skill in the art.

In another aspect of the present invention, the universal dimming ballast platform can generate zero filament voltage between full light output and a predetermined minimum current level such that ballast efficiency is maximized.

In another aspect of the present invention, the universal dimming ballast platform can flexibly adjust the filament voltage during both preheat and dimming operations.

In an embodiment, a universal dimming topology is provided for an electronic ballast having an inverter that provides an output current across first and second output branches for driving a light source in accordance with a dimming control input signal. A filament voltage control block modulates first and second filament heating switches to provide filament heating voltage across first and second connection terminals associated with the output branches. During a preheat operating mode, a control block disables the inverter and provides pulse width modulated control signals to the filament voltage control block to modulate the filament heating switches at a predetermined frequency. During a normal operating mode, the control block enables the inverter and provides pulse width modulated control signals to the filament voltage control block to modulate the filament heating switches in accordance with a duty ratio based on a detected output current.

In another embodiment, an electronic ballast includes an inverter having an output coupled to a first lamp connection branch, with a second lamp connection branch coupled to ground. A filament voltage control block provides a filament heating voltage across first and second lamp connection terminals associated with each of the first and second connection branches. A lamp current sensor is positioned along the second lamp connection branch. A controller is coupled to the inverter, the filament voltage control block and the lamp current sensor, and configured to independently control the filament voltage control block with respect to the lamp current generated by the inverter. The controller first provides a first control signal effective to disable the inverter and a second control signal effective to enable the filament voltage control block, and then counts for a predetermined time associated with a lamp preheat operating mode. After the predetermined time has lapsed, the controller adjusts the first control signal to enable the inverter and modulates the second control signal to define a pulse width modulated (PWM) control signal having a predetermined duty ratio. A current through the lamp current sensor is sensed and the controller then adjusts the duty ratio of the PWM signal to the filament voltage control block with respect to the sensed current.

DETAILED DESCRIPTION OF THE INVENTION

Figure 1:
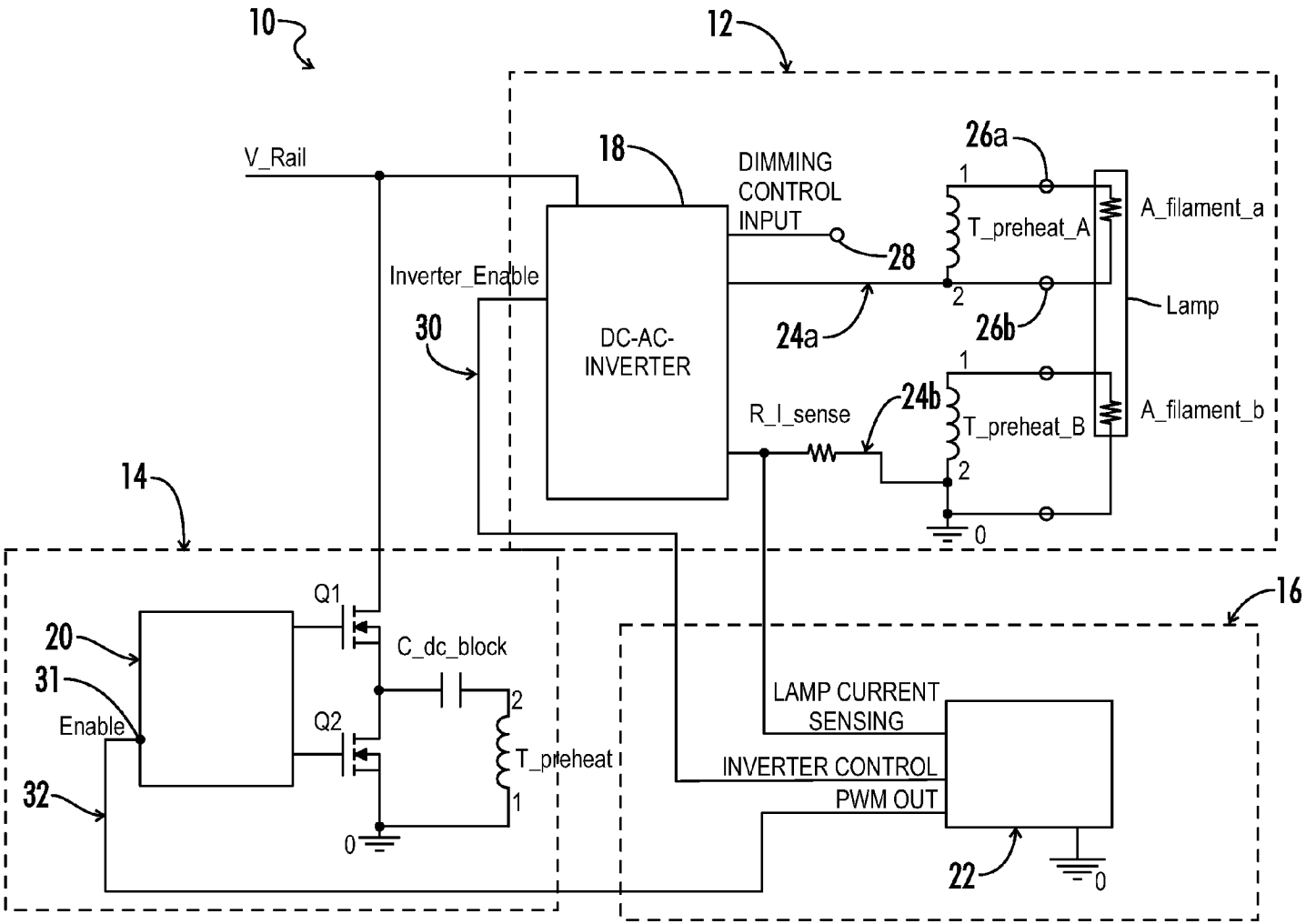
FIG. 1 is a circuit block diagram of an embodiment of a universal dimming electronic ballast platform in accordance with the present invention.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices.

The term "circuit" means at least either a single component or a multiplicity of components, either active and/or passive, that are coupled together to provide a desired function.

The term "signal" means at least one current, voltage, charge, temperature, data or other signal.

The terms "switching element" and "switch" may be used interchangeably and may refer herein to at least: a variety of transistors as known in the art (including but not limited to FET, BJT, IGBT, JFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

Terms such as "providing," "processing," "supplying," "determining," "calculating" or the like may refer at least to an action of a computer system, computer program, signal processor, logic or alternative analog or digital electronic device that may be transformative of signals represented as physical quantities, whether automatically or manually initiated.

Referring generally to FIGS. 1-10, various embodiments of a universal dimming platform for an electronic ballast are described herein. Where the various figures may describe embodiments sharing various common elements and features with other embodiments, similar elements and features are given the same reference numerals and redundant description thereof may be omitted below.

Referring first to FIG. 1, in an embodiment a universal dimming ballast platform 10 includes a dimmable lamp tank block 12, a filament voltage control tank block 14 and a control block 16.

The dimmable lamp tank block 12 as shown in FIG. 1 has the capability to drive a lamp with a range of output currents according to a dimming control input signal 28 from an external dimming control source (not shown). A DC-AC inverter 18 is coupled between a DC rail voltage V_rail of the ballast 10 and ground (0 Vdc), and is effective to provide and regulate an output signal for powering one or more gas discharge lamps. The inverter 18 may be configured to independently regulate the output signal based on a predetermined lighting output and in various embodiments may be further configured to regulate the output signal based on a dimming control signal provided from an external source (not shown).

The inverter 18 in various embodiments may be embodied as an integrated circuit, in various discrete circuit components or a combination of the same (e.g., a plurality of switching elements and a switch driver) configured to provide the functions stated herein. An Inverter Enable signal 30 may be provided to, for example, an enable pin of the inverter circuit 18 or to an associated inverter switch driver to cause the inverter 18/tank block 12 to start and stop as desired in accordance with an operating mode.

An electric light source such as a discharge lamp may be coupled to first and second output branches 24*a*, 24*b* of the tank block 12 via first and second output terminals 26*a*, 26*b* associated with each branch. Each lamp filament (R_filament_A, R_filament_B) may be driven by a secondary winding (T_preheat_A, T_preheat_B) of a transformer T_preheat_coupled across the first and second lamp connection (output) terminals 26*a*, 26*b* for each branch, respectively. In an embodiment as shown in FIG. 1, each branch may be coupled directly to the inverter 18, but in certain embodiments only the first branch 24*a* may be coupled to a single output terminal of the inverter 18 while the second branch 24*b* is coupled to power ground.

A current sensing resistor R_I_sense may, in various embodiments, be used as a lamp current sensor effective to sense the lamp current which is correspondingly fed back to the control block 16.

The filament voltage control block 14 as shown in FIG. 1 may be dedicated to provide a filament heating voltage as determined by the control block 16. The filament voltage control block 14 in one embodiment includes a half bridge DC-AC inverter having first and second switching elements Q1, Q2, a self-oscillating switch driver circuit 20, a capacitor C_dc_block and a primary winding of the preheat transformer T_preheat. A first secondary winding T_preheat_A may be coupled across the first and second connection terminals 26*a*, 26*b* of the first output branch 24*a* in the dimmable lamp tank block 12, and a second secondary winding T_preheat_B may be coupled across the first and second connection terminals of the second output branch 24*b* in the dimmable lamp tank block 12. Accordingly, a voltage generated across the primary winding of the filament transformer provides a corresponding voltage across the secondary windings based in part on the turns ratio between the primary and secondary windings and further across any lamp filaments coupled to the respective lamp connection terminals.

An enable pin 31 of the half bridge driver 20 may cause enabling or disabling of the filament voltage control block 14 in accordance with a filament voltage control block enable/disable signal 32 provided from the control block 16.

The control block 16 may include a controller 22 such as a general purpose microprocessor, an application specific integrated circuit (ASIC), a digital signal processor (DSP), a microcontroller, a field programmable gate array, or various alternative blocks of discrete circuitry as known in the art, designed or otherwise effective to sense the lamp current, and accordingly provide independent control signals effective to control both of the dimmable lamp tank 12 and the filament voltage control tank 14.

Figure 2:
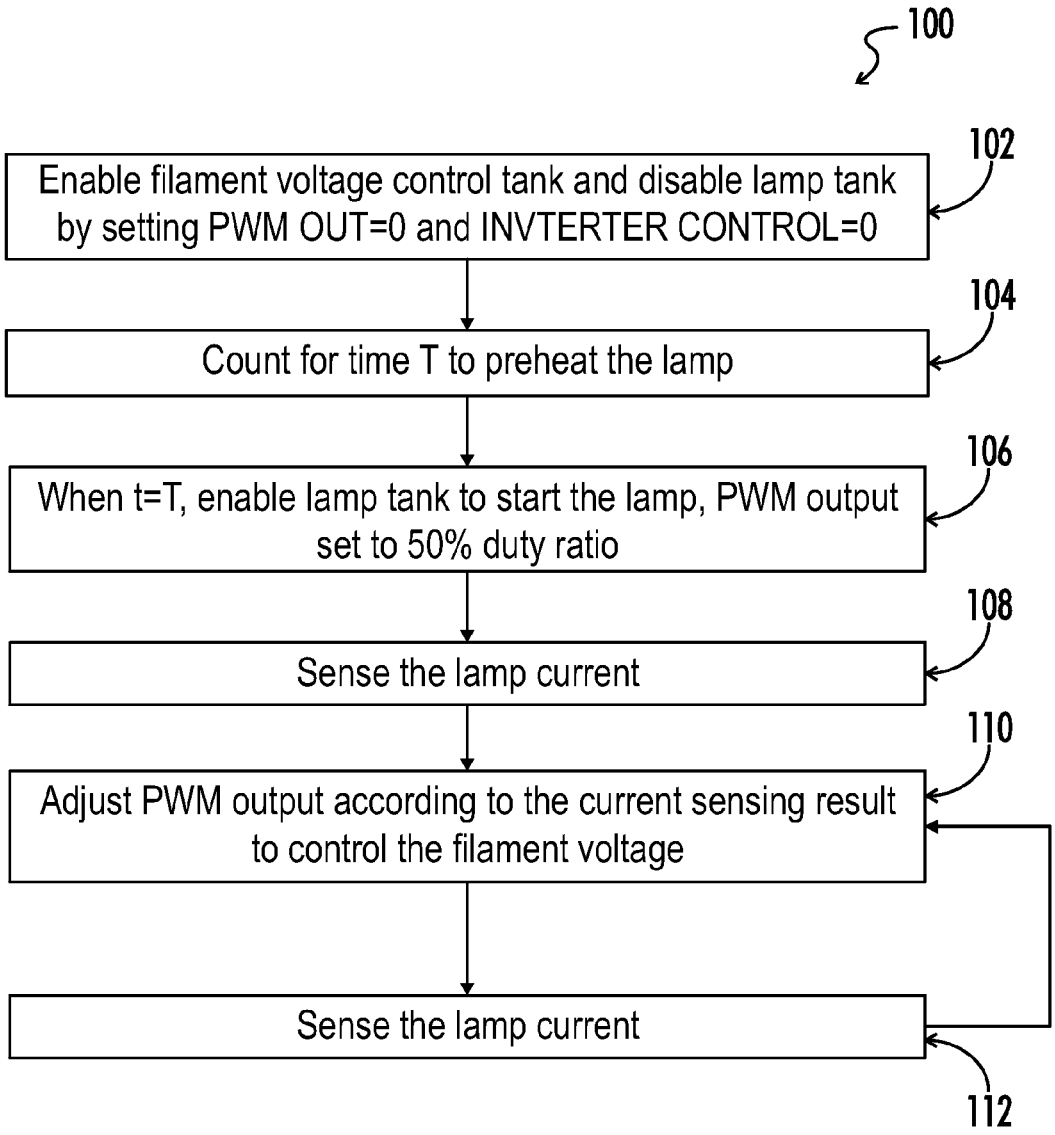
FIG. 2 is a flowchart representing an embodiment of an operating method of the dimming platform as shown in FIG. 1.

Referring now to FIG. 2, a method of operation 100 for the platform 10 as represented in FIG. 1 and in accordance with an embodiment of the present invention includes the following steps.

Before lamp startup (step 102) the controller 22 enables the filament voltage control tank 14 to provide a preheat voltage across lamp filaments R_filament_A, R_filament_B by generating and providing a filament voltage control signal 32 having a first value 32*a*. In various embodiments, this may entail setting the filament voltage control signal 32 from the controller 22 to zero (PWM OUT=0), providing an output signal which enables the filament voltage control tank without pulse width modulation (PWM) of the output signal. The operating frequency for the filament voltage control tank 14 is set to a predetermined frequency F_preheat. The controller 22 further disables the DC-AC inverter 18 by setting the inverter control signal 30 to a first setting or value (e.g., "0"). In this manner the voltage across the lamp during the preheat operating mode may be set to zero such that no glow current occurs during the preheating operation, which may provide benefits such as extending lamp life.

The controller counts off a predetermined amount of time T to preheat the lamp filaments for T seconds (step 104). In various embodiments, the predetermined time T may be programmed in the controller 22 in accordance with a type of lamp and an associated preheat time, and the predetermined time T may further in certain embodiments be adjustable with respect to the controller 22.

After an elapsed time is determined by the controller 22 to be greater than the predetermined preheat time (t>T), the controller 22 enables the inverter 18 by adjusting the inverter control signal 30 or otherwise setting the inverter control signal 30 to a second setting or value with respect to the preheat operating mode (e.g., "1"). The inverter 18 then starts the lamp as described above or otherwise as is well known in the art, and the controller 22 modulates the filament voltage control signal so as to produce or otherwise define a pulse width modulated (PWM) control signal having a duty ratio of for example 0.5 (e.g., PWM OUT=50%) to limit the filament voltage (step 106). The initial or default duty ratio of 0.5 for the filament voltage control signal upon entering the normal mode is merely intended as exemplary, and other values may alternatively be used within the scope of the present invention.

After the lamp starts, the controller 22 begins to sense the lamp current (step 108) and further modulates the filament voltage control signal 32 or otherwise adjusts PWM OUT according to the sensed lamp current (step 110). The controller 22 continuously repeats the previous steps of sensing the lamp current during normal operation (step 112) and adjusting PWM OUT according to changes in the lamp current. In an example as described herein where the filament voltage tank 14 is enabled with PWM OUT=0 and disabled with PWM OUT=1, the controller 22 may correspondingly increase the duty ratio of the PWM signal in response to an increase in the detected lamp current and further decrease the duty ratio of the PWM signal in response to a decrease in the detected lamp current. In an alternative case where the pin values and their respective effects were reversed, the controller may reverse the PWM signal algorithm as well. Continuous and independent RMS filament voltage control is thereby provided, with the filament voltage flexibly set at any point between zero and V_rail/2*N as needed in accordance with various operations (e.g., preheat, full lamp current, various dimming levels).

Figure 3A:
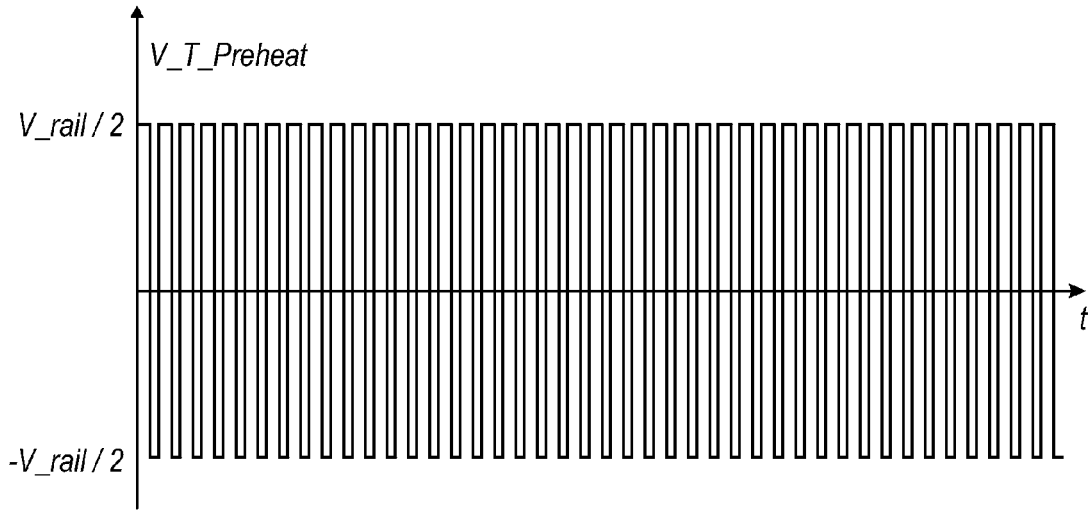
FIGS. 3A and 3B are graphical diagrams representing a voltage provided during a preheat operating mode across primary and secondary windings, respectively, of the preheat transformer shown in FIG. 1 and in accordance with the method of FIG. 2.
Figure 3B:
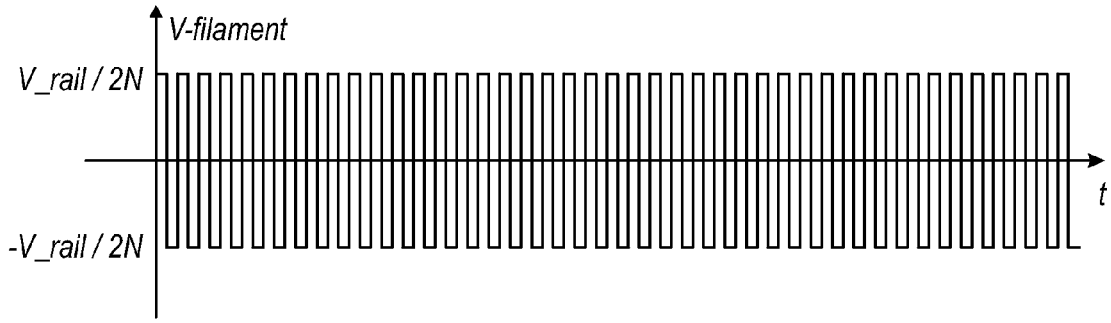

In normal preheat mode, the voltage across the primary winding of the preheat transformer T_preheat_is as shown in FIG. 3A, with the voltage across each of the secondary windings of the preheat transformer T_preheat_A, T_preheat_B as shown in FIG. 3B. The peak voltage across the primary winding of the preheat transformer T_preheat_is V_rail/2 and the peak voltage across each of the secondary windings of the preheat transformer T_preheat_A, T_preheat_B and accordingly across the lamp filaments is V_rail/2*N, where N is the turns ratio between the primary winding and each of the secondary windings of the preheat transformer.

When the inverter 18 receives the dimming control signal from the dimming control source, the inverter (when enabled) adjusts the lamp current according to the control signal. The controller 22 is always sensing the lamp current and making a decision how to heat the filaments by adjusting a duty ratio of the signal PWM OUT. The decision is made in accordance with PWM control algorithms and generally may be based on at least a predetermined relationship between the filament voltage and lamp current as set by, for example, ANSI-IEC standards. If the enable pin 31 of the self-oscillating half-bridge driver 20 is at a zero level, the driver is enabled. If the enable pin 31 of the self-oscillating half-bridge driver 20 is at a one level, the driver is disabled such that the preheat tank stops working.

The PWM OUT frequency, F_PWM, may be set for example to a few times less than the preheat frequency F_preheat. By adjusting the duty ratio, PWM OUT can shut down the filament voltage control tank 14 for a period of time to reduce the filament heating. The larger the duty ratio (D), the smaller the filament heating voltage provided by the tank 14. The filament voltage V_filament=D*(V_rail/2N).

Figure 4A:
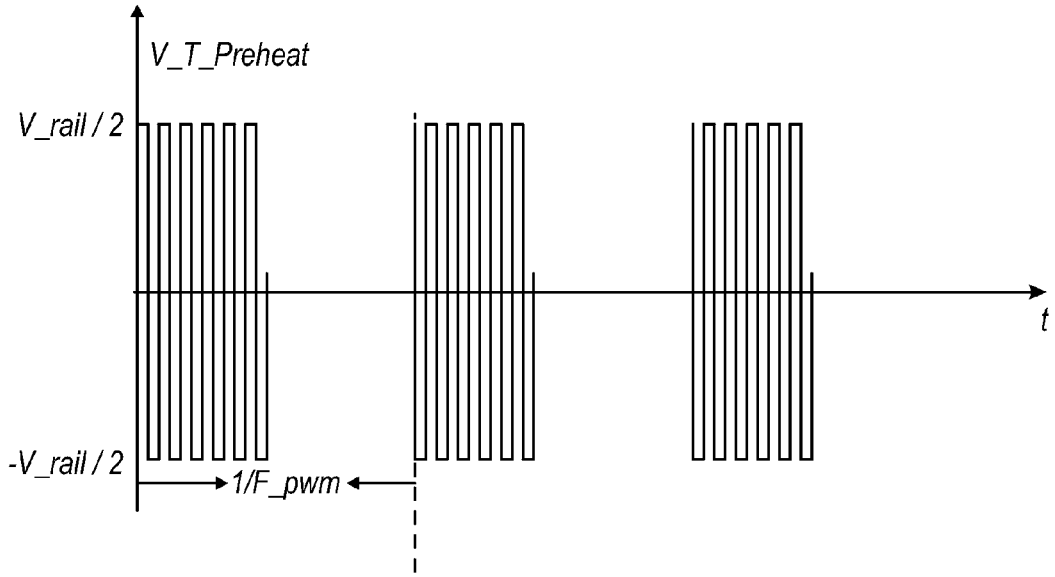
FIGS. 4A and 4B are graphical diagrams representing a 50% modulated voltage provided at the beginning of a normal operating mode across primary and secondary windings, respectively, of the preheat transformer shown in FIG. 1 and in accordance with the method of FIG. 2.
Figure 4B:
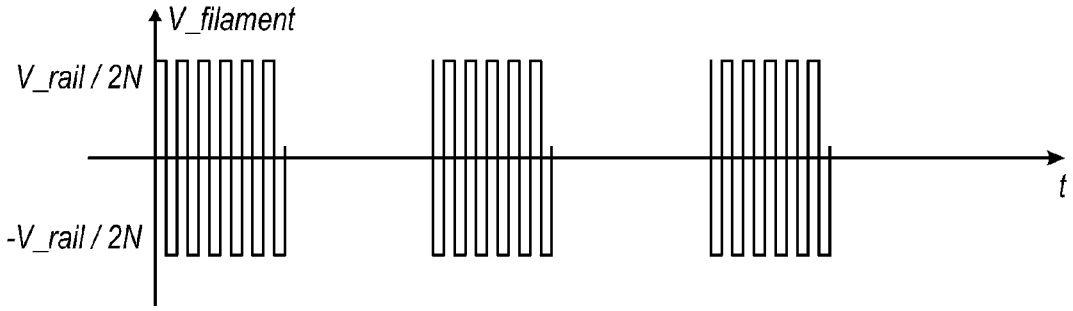

A 50% modulated filament voltage is represented in FIGS. 4A and 4B.

Figure 5A:
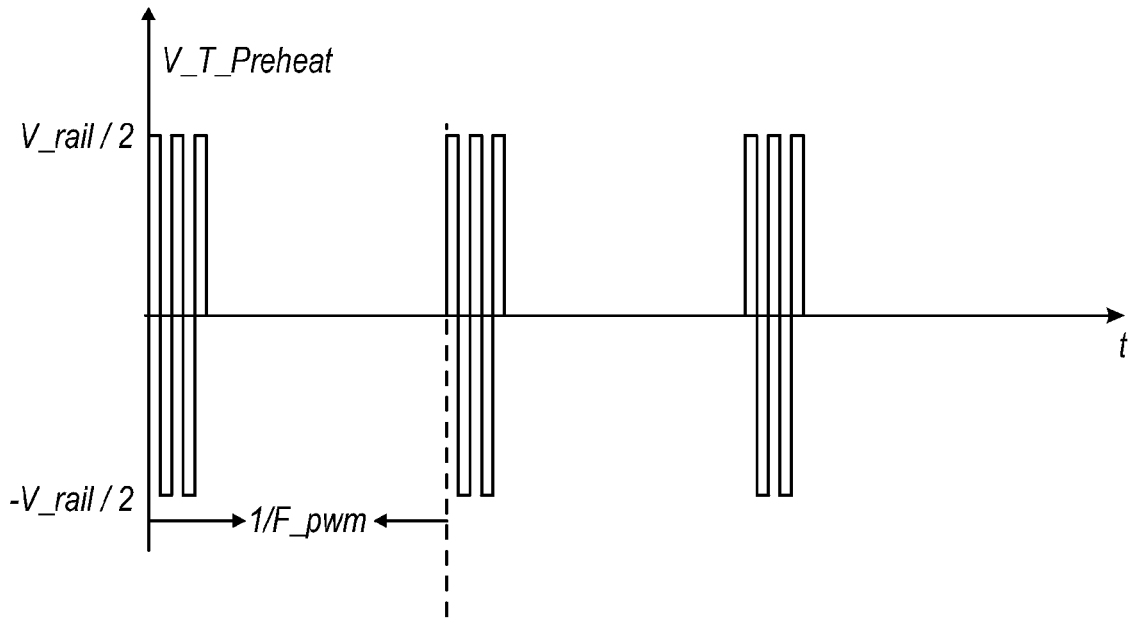
FIGS. 5A and 5B are graphical diagrams representing a 20% modulated voltage provided during a normal operating mode across primary and secondary windings, respectively, of the preheat transformer shown in FIG. 1 and in accordance with the method of FIG. 2.
Figure 5B:
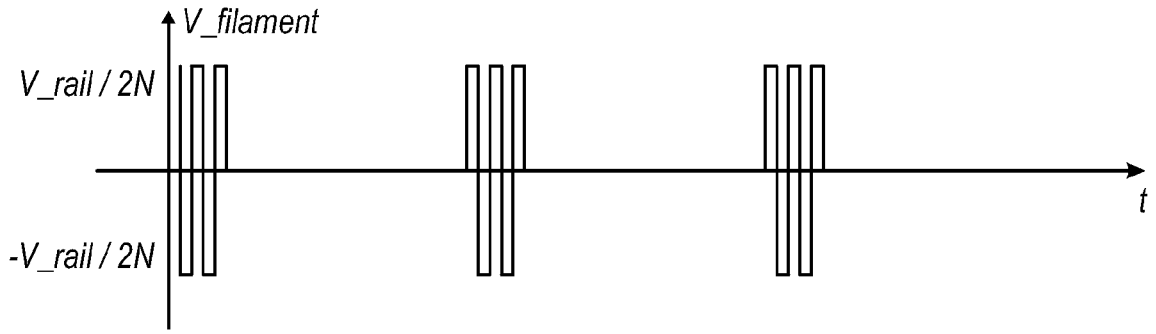

A 20% modulated filament voltage is represented in FIGS. 5A and 5B.

Figure 6:
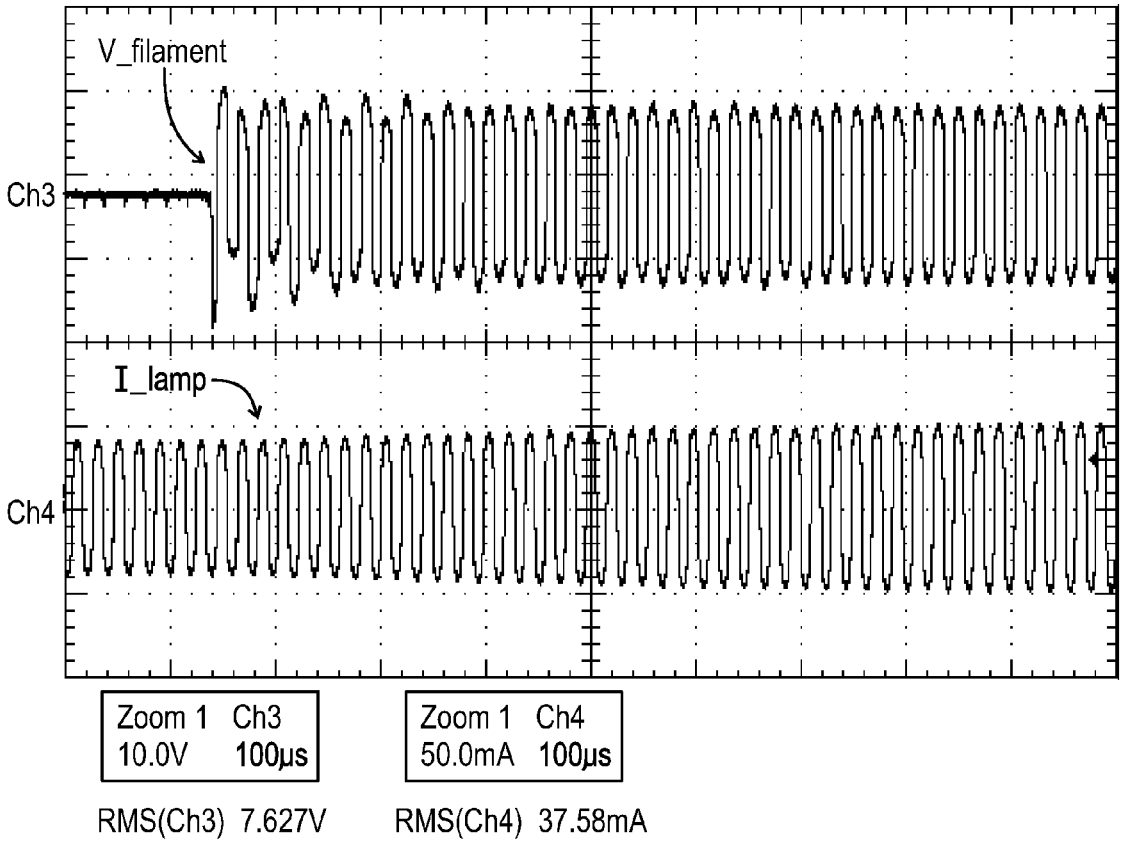
FIG. 6 is a graphical diagram representing a filament heating voltage provided by the filament voltage control block based on a detected 10% output current from the inverter block in the embodiment of FIG. 1.
Figure 7:
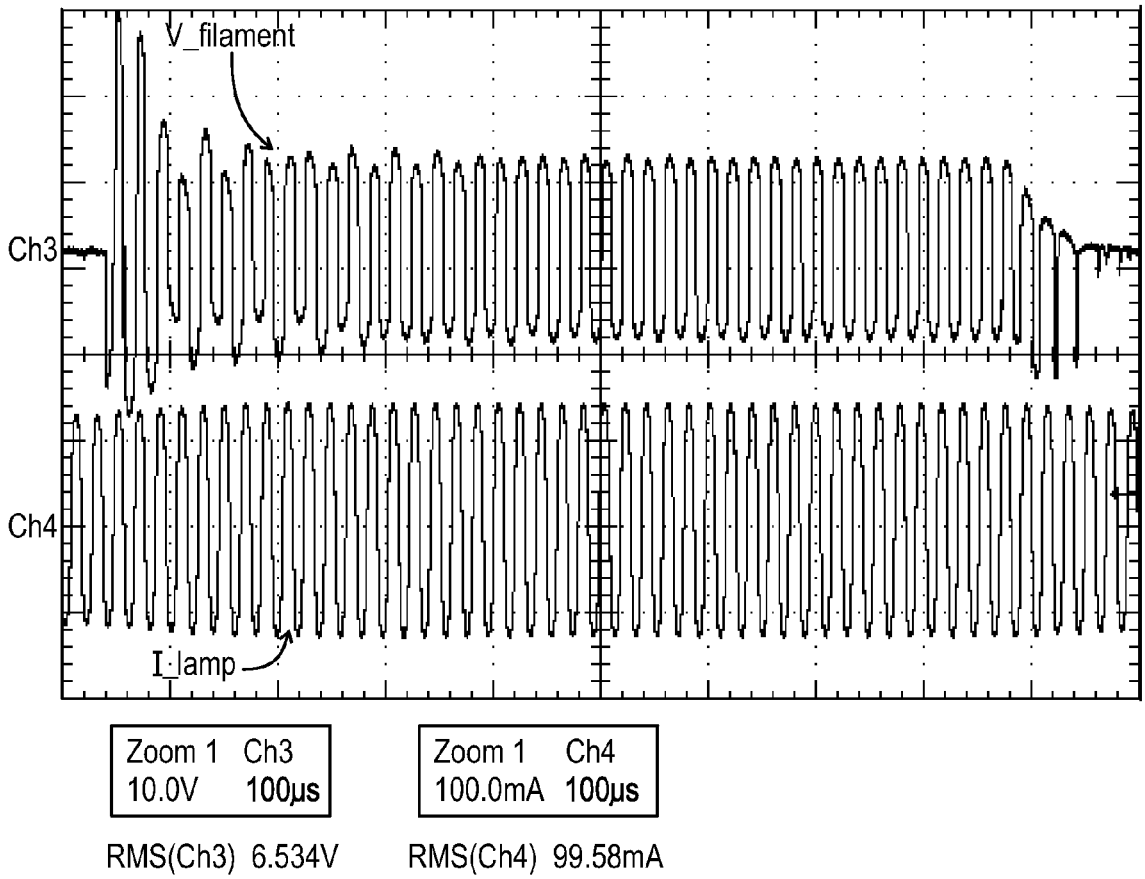
FIG. 7 is a graphical diagram representing a filament heating voltage provided by the filament voltage control block based on a detected 30% output current from the inverter block in the embodiment of FIG. 1.
Figure 8:
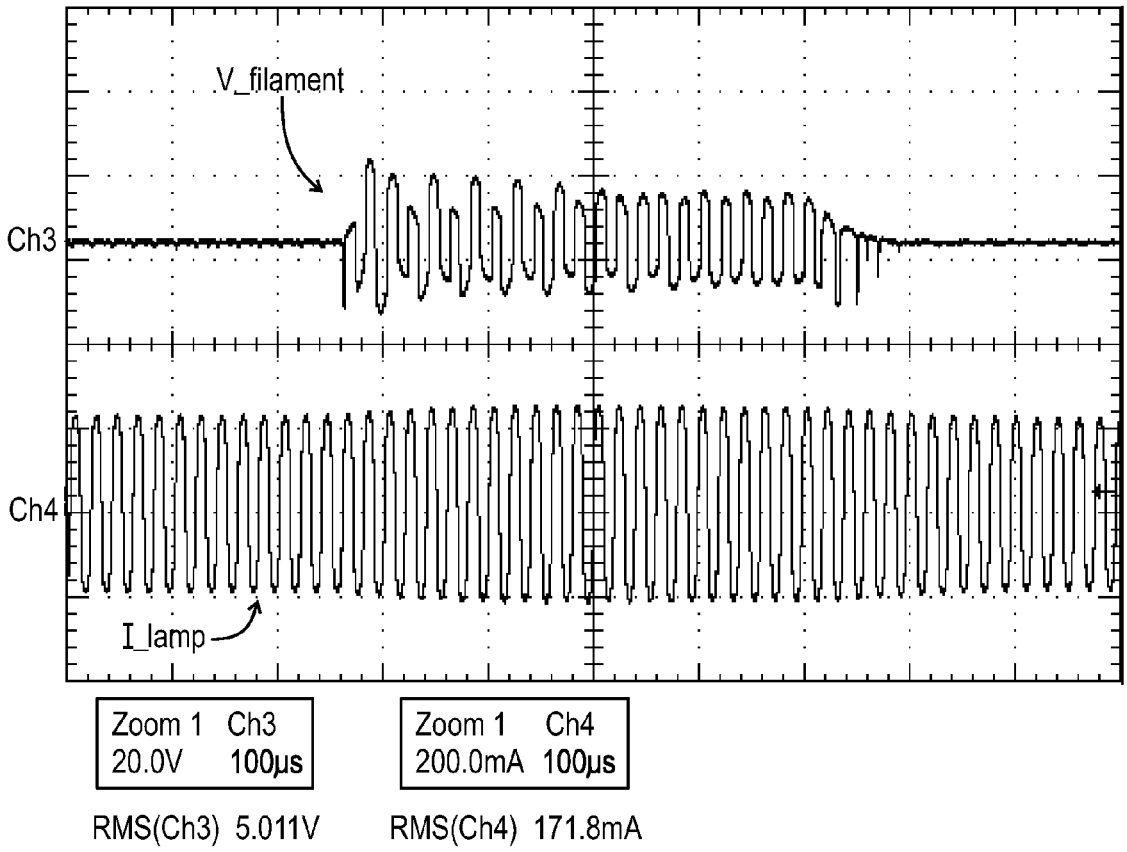
FIG. 8 is a graphical diagram representing a filament heating voltage provided by the filament voltage control block based on a detected 50% output current from the inverter block in the embodiment of FIG. 1.
Figure 9:
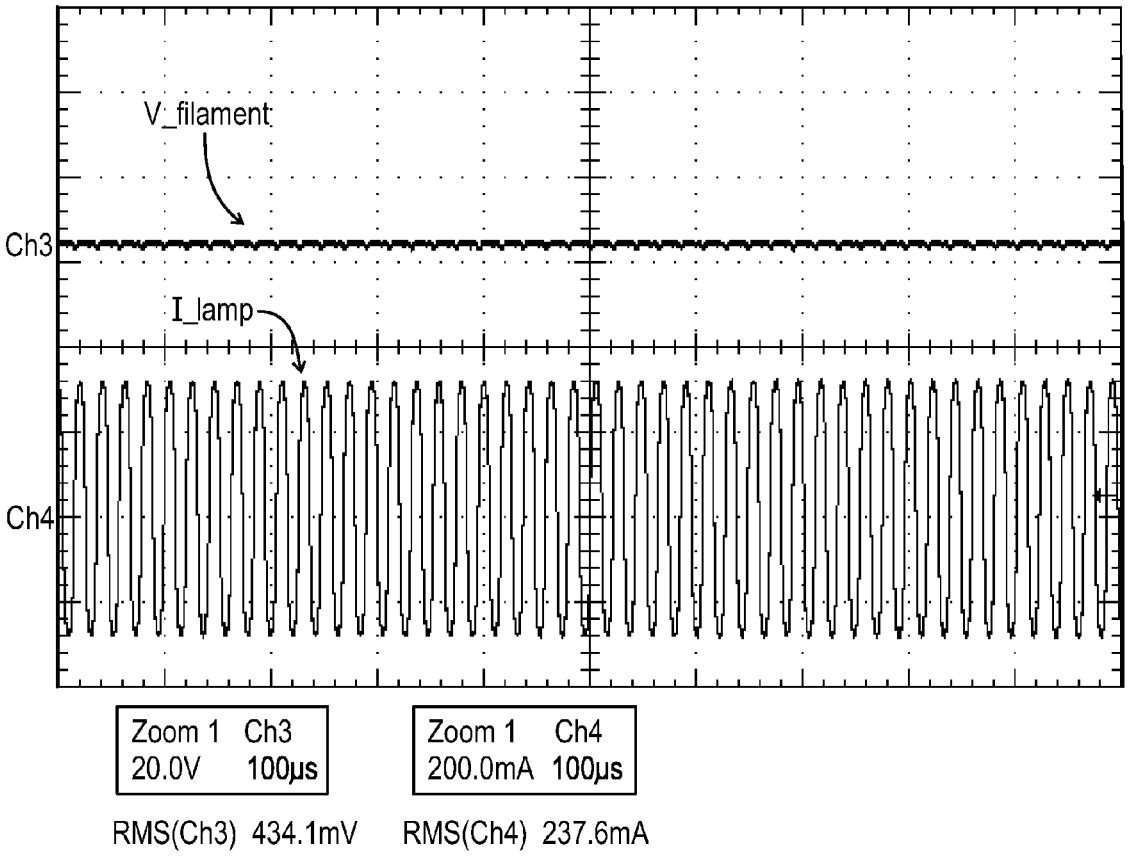
FIG. 9 is a graphical diagram representing a filament heating voltage provided by the filament voltage control block based on a detected 70% output current from the inverter block in the embodiment of FIG. 1.

FIGS. 6 to 10 generally represent filament heating voltages provided by the filament voltage control block 14 based on a plurality of detected lamp currents. FIG. 6 represents a filament heating voltage of 7.627 V generated in accordance with a detected 10% output current from the dimming lamp tank block 12. FIG. 7 represents a filament heating voltage of 6.534 V generated in accordance with a detected 30% output current. FIG. 8 represents a filament heating voltage of 5.011 V generated in accordance with a detected 50% output current. FIG. 9 represents a filament heating voltage of 0.434 V generated in accordance with a detected 70% output current.

Figure 10:
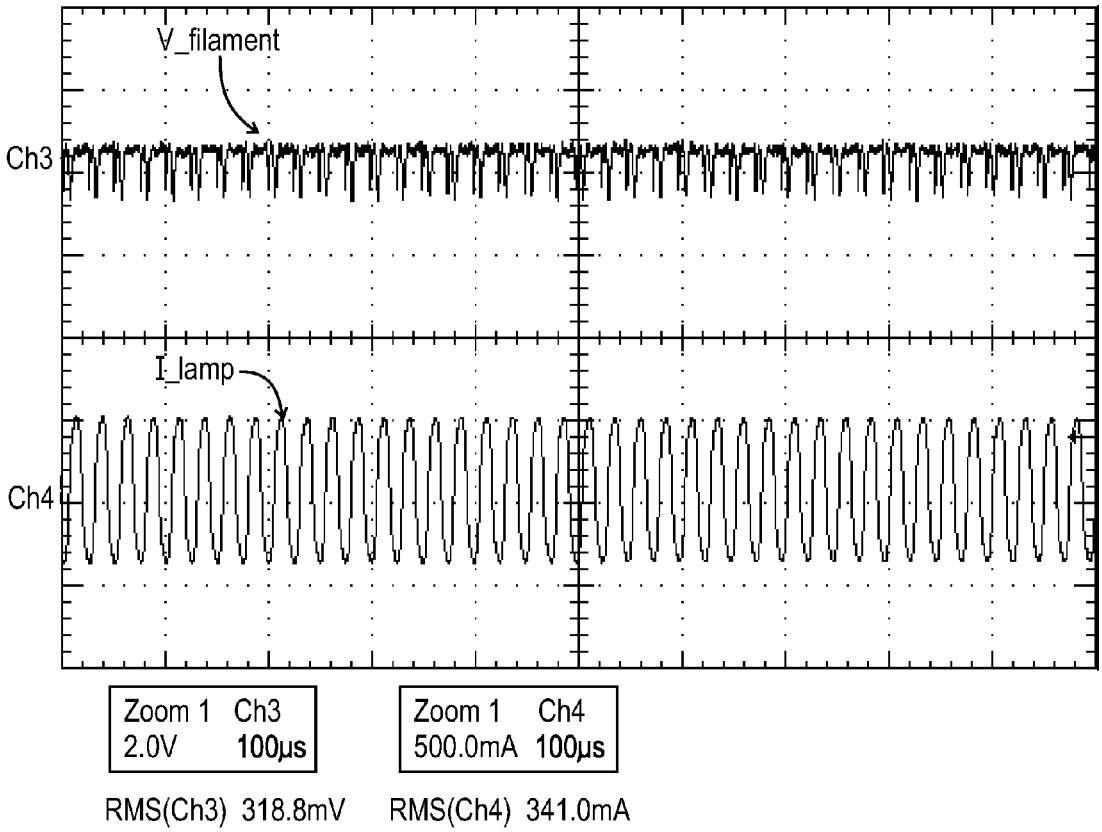
FIG. 10 is a graphical diagram representing a filament heating voltage provided by the filament voltage control block based on a detected 100% output current from the inverter block in the embodiment of FIG. 1.

FIG. 10 represents a filament heating voltage of 0.318 V generated in accordance with a detected 100% output current.

Thus, although there have been described particular embodiments of the present invention of a new and useful UNIVERSAL DIMMING BALLAST PLATFORM it is not intended that such references be construed as limitations upon the scope of this invention except as set forth in the following claims.

What is claimed is:

1. An electronic ballast comprising:

first and second output branches, each including associated first and second connection terminals;

an inverter effective to provide an output signal across each of the first and second output branches in accordance with a dimming control input signal;

a filament voltage control block effective to provide a filament heating voltage across the first and second connection terminals associated with each of the first and second output branches;

a control block effective to control the inverter and the filament voltage control block in accordance with a preheat operating mode during which the control block is effective to provide a first control signal to disable the inverter and to provide a second control signal to enable the filament voltage control block, and a normal operating mode during which the control block is effective to adjust the first control signal to enable the inverter and to modulate the second control signal to define a pulse width modulated (PWM) control signal having a duty ratio based on a detected output signal from the inverter and;

the filament voltage control block further comprises first and second filament heating switches coupled in series between a DC rail voltage and ground, a driver circuit effective to drive the first and second filament heating switches, a filament heating transformer having a primary winding coupled on a first end to a node between the first and second filament heating switches and on a second end to ground, and the control block is effective during the preheat operating mode to provide the second control signal to enable the driver circuit to drive the first and second filament heating switches at a predetermined frequency.

2. The electronic ballast of claim 1, the control block further effective to count a predetermined time after initiating the preheat operating mode, and after lapsing of the predetermined time to initiate the normal operating mode.

3. The electronic ballast of claim 2, the predetermined time associated with the preheat operating mode being adjustable based on a desired filament preheating time.

4. The electronic ballast of claim 1, further comprising a lamp current sensor, the control block being effective to modulate the second control signal to define a pulse width modulated (PWM) control signal having a duty ratio based on a detected lamp current provided from the lamp current sensor.

5. The electronic ballast of claim 4, wherein the lamp current sensor comprises a sense resistor in the second output branch.

6. The electronic ballast of claim 1 wherein:

the first output branch comprises a first secondary winding of the filament heating transformer coupled on a first end to the first output terminal of the first branch and on a second end to the second output terminal of the first branch to receive the output signal from the inverter; and the second output branch comprises a second secondary winding of the filament heating transformer coupled on a first end to the first output terminal of the second branch and on a second end to the second output terminal of the second branch and further to ground.

7. A method of operating an electronic ballast comprising the steps of:

providing a first control signal from a ballast control block effective to disable a dimmable lamp tank block having first and second lamp connection branches and first and second connection terminals associated with each of said branches;

providing a second control signal from the ballast control block effective to enable a filament voltage control block configured to provide a filament heating voltage across each pair of connection terminals;

counting in the ballast control block for a predetermined time associated with a lamp preheat operating mode;

after the predetermined time has lapsed, adjusting the first control signal to enable the dimmable lamp tank block and modulating the second control signal to define a pulse width modulated (PWM) control signal having a predetermined duty ratio;

sensing a current through a lamp current sensor; and adjusting the duty ratio of the PWM signal to the filament voltage control block with respect to the sensed current.

8. The method of claim 7, the dimmable lamp tank block further comprising an inverter having a first input terminal coupled to receive a dimming control input signal and a second input terminal coupled to receive the first control signal from the ballast control block, the inverter further coupled to the first lamp connection branch and effective to generate an output signal across the first and second lamp connection branches in accordance with the received dimming control input signal.

9. The method of claim 8, the lamp current sensor comprising a sense resistor positioned along the second lamp connection branch.

10. The method of claim 9, the predetermined time associated with the lamp preheat operating mode being adjustable within the ballast control block based on a desired filament preheating time.

11. The method of claim 8, wherein the step of providing a second control signal from the ballast control block effective to enable a filament voltage control block configured to provide a filament heating voltage across each pair of connection terminals comprises:

providing a second control signal from the ballast control block effective to enable a driver circuit to drive first and second filament heating switches coupled in series between a DC rail voltage and ground;

generating a first filament heating voltage across a primary winding of a filament heating transformer coupled on a first end to a node between the first and second filament heating switches and on a second end to ground; and generating a second filament heating voltage across a first secondary winding of the filament heating transformer coupled to the first and second output terminals of the first branch and a second secondary winding of the filament heating transformer coupled to the first and second output terminals of the second branch.

12. The method of claim 11, further comprising driving said first and second filament heating switches at a first predetermined frequency during the time associated with the lamp preheat operating mode, and at a second predetermined frequency after lapsing of the time associated with the lamp preheat operating mode.

13. The method of claim 7, wherein the step of adjusting the duty ratio of the PWM signal to the filament voltage control block with respect to the sensed current comprises:

increasing the duty ratio of the PWM signal to the filament voltage control block in response to increases in the sensed current through the lamp current sensor; and decreasing the duty ratio of the PWM signal to the filament voltage control block in response to decreases in the sensed current through the lamp current sensor.

14. An electronic ballast comprising:

a first lamp connection branch having first and second lamp connection terminals;

an inverter having an output coupled to the first lamp connection branch;

a second lamp connection branch coupled to ground and having first and second lamp connection terminals;

a filament voltage control block effective to provide a filament heating voltage across the first and second lamp connection terminals associated with each of the first and second connection branches;

a lamp current sensor;

a controller coupled to the inverter, the filament voltage control block and the lamp current sensor; and the controller is configured to provide a first control signal effective to disable the inverter and a second control signal effective to enable the filament voltage control block, count for a predetermined time associated with a lamp preheat operating mode, after the predetermined time has lapsed, adjust the first control signal to enable the inverter and modulate the second control signal to define a pulse width modulated (PWM) control signal having a predetermined duty ratio, sense a current through the lamp current sensor; and adjust the duty ratio of the PWM signal to the filament voltage control block with respect to the sensed current.

15. The electronic ballast of claim 14, the inverter having a first input terminal coupled to receive a dimming control input signal from a dimming control source and a second input terminal coupled to receive the first control signal from the controller, the inverter effective to generate an output signal across the first and second lamp connection branches in accordance with the received dimming control input signal.

16. The electronic ballast of claim 15, the predetermined time associated with the lamp preheat operating mode being adjustable within the controller based on a desired filament preheating time.

17. The electronic ballast of claim 15 further comprising:

the filament voltage control block includes first and second filament heating switches coupled in series between a DC rail voltage and ground, a driver circuit effective to drive the first and second filament heating switches, and filament heating transformer having a primary winding coupled on a first end to a node between the first and second filament heating switches and on a second end to ground;

the first lamp branch comprises a first secondary winding of the filament heating transformer coupled to the first and second output terminals of the first branch;

the second lamp branch comprises a second secondary winding of the filament heating transformer coupled to the first and second output terminals of the second branch; and the controller is configured to provide a second control signal which enables the driver circuit to generate a first filament heating voltage across the primary winding and thereby generate a second filament heating voltage across the first secondary winding and the second secondary winding.

18. The electronic ballast of claim 17, wherein the controller is configured to enable the driver to drive the first and second filament heating switches at a first predetermined frequency during the time associated with the lamp preheat operating mode, and at a second predetermined frequency after lapsing of the time associated with the lamp preheat operating mode.

19. The electronic ballast of claim 14, wherein controller is configured to increase the duty ratio of the PWM signal to the filament voltage control block in response to increases in the sensed current through the lamp current sensor, and to decrease the duty ratio of the PWM signal to the filament voltage control block in response to decreases in the sensed current through the lamp current sensor.

* * * * *